United States Patent [19]

Parish

[11] Patent Number: 4,499,844

[45] Date of Patent: Feb. 19, 1985

[54] METHOD AND APPARATUS FOR RELEASING A SUBMERGED LIFE RAFT

[75] Inventor: James M. Parish, Wadsworth, Ohio

[73] Assignee: The B. F. Goodrich Company, New York, N.Y.

[21] Appl. No.: 544,344

[22] Filed: Oct. 24, 1983

[51] Int. Cl.[3] ..... B63B 23/00

[52] U.S. Cl. ..... 114/367; 114/379

[58] Field of Search ..... 114/366–369, 114/365, 376–380

[56] References Cited

U.S. PATENT DOCUMENTS

| | | | |
|---|---|---|---|
| 2,313,802 | 3/1943 | Carlsen | 114/367 |
| 3,343,188 | 9/1967 | Tuck | 114/367 |
| 4,124,911 | 11/1978 | Wildhagen | 114/367 |
| 4,145,782 | 3/1979 | De Sepio et al. | 114/365 |

*Primary Examiner*—Trygve M. Blix
*Assistant Examiner*—Edwin L. Swinehart
*Attorney, Agent, or Firm*—Michael J. Colitz, Jr.; Woodrow W. Ban

[57] ABSTRACT

A davit launched inflatable life raft in a rigid container fastened to a deck by releasable latches is released and the raft inflated at a predetermined depth in a float free mode. A painter line fastened to the life raft is releasably connected to a retaining member mounted on the deck so that upon release of the container the retaining member will be actuated and the painter line secured to the retaining member to limit movement of the raft on the surface of the water to the area over the retaining member. A release lanyard for the davit hook and raft actuating cables connected to the lid fasteners are also releasably held in the retaining member for releasing the davit hook from the raft supporting davit ring and for releasing the fasteners holding the lid in place. Lifting of the flotable container provides relative movement of the retaining member mounted on the deck and the container to actuate a locking hook of the retaining member. Further movement of the container places the release lanyard and the cables in tension to open the container and release the davit hook. During normal launching in the davit launch mode the cables, release lanyard and painter line are automatically removed from the retaining member and the normal davit mode launching of the raft is not affected.

15 Claims, 6 Drawing Figures

METHOD AND APPARATUS FOR RELEASING A SUBMERGED LIFE RAFT

BACKGROUND OF THE INVENTION

This invention relates to a davit launched inflatable life raft contained in a rigid container fastened to the deck of a ship or offshore oil drilling platform. The container is fastened to the deck and only opened when a load is applied by the davit hook on the davit ring through the fall powered by the davit. When the deck is submerged it is important that the raft be automatically inflated and connected to the deck by a painter line to retain the raft in the immediate area over the launching site. It is also important that the container be opened and the raft disconnected from the fall so that when the inflated raft reaches the surface it will be in condition for boarding by persons to be rescued.

SUMMARY OF THE INVENTION

The present invention provides a method and apparatus for releasing a davit launched rigid container life raft from a submerged deck. This float free system is easily installed and launching in the float free mode is provided without adversely affecting launching in the davit launch mode. A retaining member is mounted on the deck so that upon release of the container the retaining member will be actuated and a painter line secured to the retaining member to limit movement of the raft on the surface of the water. A release lanyard for the davit hook and the cables to the lid fasteners are also releasably held in the retaining member for detaching the davit hook from the raft supporting davit ring and for releasing the fasteners holding the lid in place. The retaining member which is mounted on the deck has a locking hook member which is actuated by lifting of the container off the deck when it is released from the deck. This upward movement of the container places the release lanyard and other cables in tension to open the container and release the davit hook. During normal launching of the raft by the davit and fall the cable release lanyard and painter line are automatically removed from the retaining member and the normal launching of the raft is not adversely affected.

In accordance with one aspect of the invention there is provided a raft release apparatus for releasing a raft from a submerged deck having at least one latch connecting the raft to the deck and a painter line fastened to the raft comprising a retaining member mounted on the deck, the painter line being removably connected to the retaining member, means for releasing the latch at a predetermined depth of the deck below the surface of the water and the retaining member being actuated in response to lifting of the raft from the deck to secure the painter line to the deck and limit the movement of the raft in the inflated condition on the surface of the water to the area over said retaining member.

In accordance with another aspect of the invention there is provided a method of releasing a raft from a submerged deck at a predetermined depth wherein latch means connect the raft to the deck comprising (a) releasably fastening a painter line connected to the raft to a retaining member mounted on the deck prior to submersion, (b) actuating the latch means to release the raft from the deck in response to submerging the deck to the predetermined depth, and (c) actuating the retaining member to secure the painter line to the retaining member in response to lifting movement of the raft off the deck so as to limit the movement of the raft on the surface of the water to the area over the retaining member.

DETAILED DESCRIPTION

Figure 1:
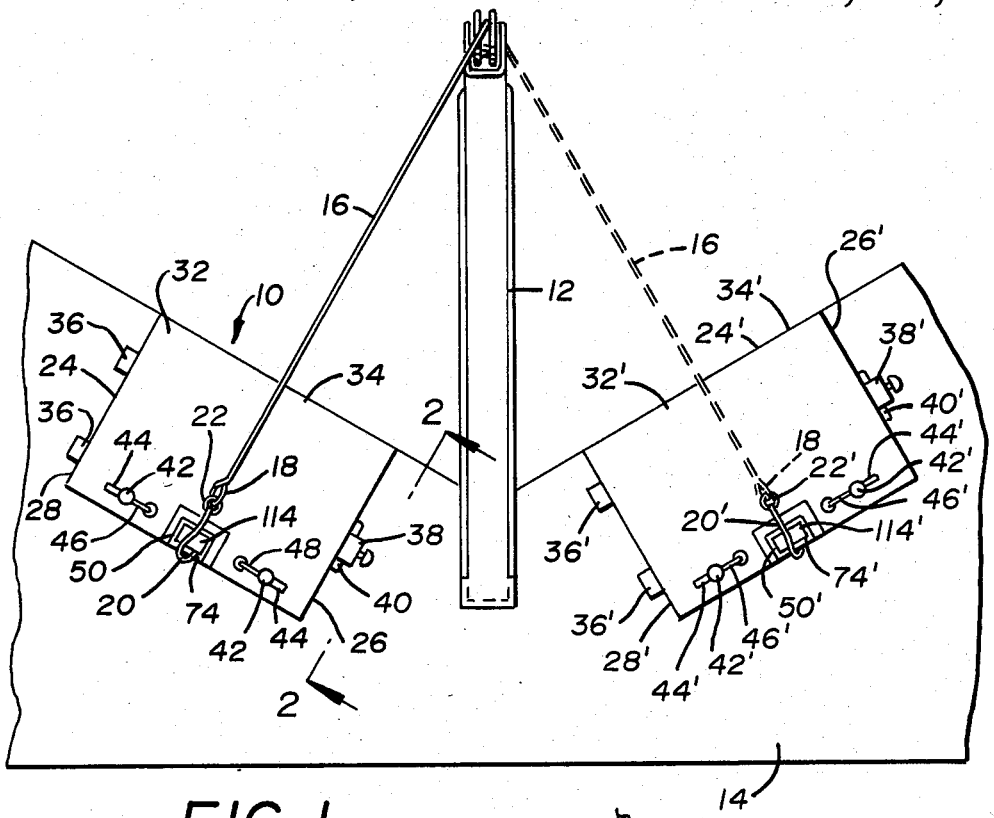
FIG. 1 is a plan view of the davit and a first raft in a first container mounted on the deck of a ship or oil well platform with the fall connected to the raft in the first container and a second raft in a second container mounted on the deck with the position of the fall being shown in dotted lines.
Figure 2:
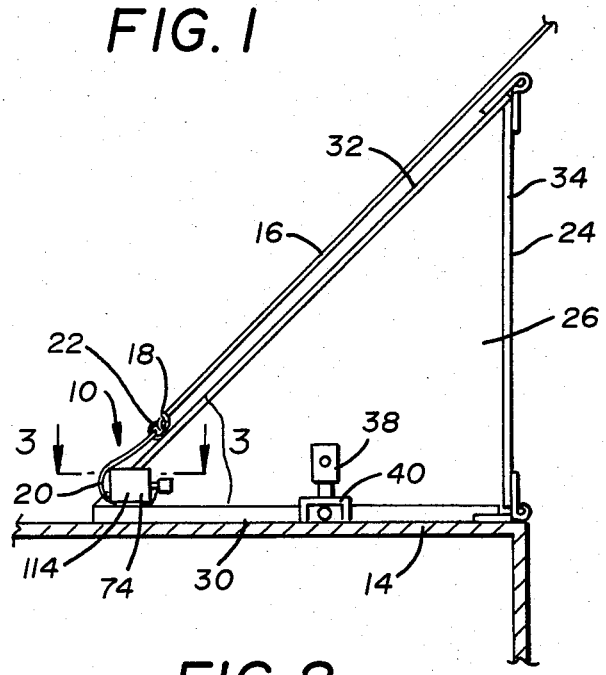
FIG. 2 is an enlarged fragmentary end view of the first container taken along the line 2—2 in FIG. 1, parts being broken away.

Referring to FIGS. 1 and 2, a davit launch rigid container life raft embodying float free raft release apparatus 10 is shown. A davit 12 is mounted on a deck 14 of a ship or oil well rig and is connected by a fall 16 to a davit hook 18 which is of a quick-release type having a release lanyard 20. The davit hook 18 is connected to a raft lifting davit ring 22 which is connected to an inflatable raft (not shown) positioned in a space within a suitable container such as container 24 having triangular side members 26 and 28 mounted on a bottom member 30 and having a hinged lid 32 connected to a hinged back member 34. The container 24 is releasably mounted on the deck 14 by latch means for releasing the container at a predetermined depth. In this embodiment the latch means includes angles (not shown) on the side member 26 for sliding engagement with straps 36 which may be welded to the deck 14. At the other end of the container 24 a hydrostatic release mechanism 38 connects the side member 26 to a lug 40 fastened to the deck 14. The hydrostatic release mechanism 38 may be set to release the container 24 from the lug 40 at a depth of from 10 to 25 feet (3.05 to 7.62 meters).

The lid 32 is fastened to the bottom member 30 of the container 24 by releasable fasteners such as posts 42 extending upwardly from the bottom member into latches (not shown) in the lid with pins 44 extending through the posts and on top of the latches. Raft actuating cables 46 and 48 are connected to the pins 44 for releasing the lid 32.

In the davit launch system shown, a first container 24 is connected to the davit 12 by the fall 16 and a second container 24' is positioned for connection to the fall indicated by dotted lines after the first container has been launched. The parts of the second container 24' corresponding to the parts of the first container 24 are indicated by the prime mark after the numbers.

Referring to FIGS. 1 and 3 through 5, an opening 50 is provided in the bottom member 30 of the container 24 for a retaining member 52 mounted on the deck 14. The retaining member 52 may have a base 54 fastened to the deck 14 by suitable means such as welding and a locking hook assembly including a locking hook 56 having an upper end portion 58. The upper end portion 58 has a tight radius at distal end 60 so that the distal end is closer to the base 54 than the upper end portion. The locking hook 56 has a lower slide portion 62 slidably mounted in a locking hook guide member which includes a tubular guide 64 in the base 54. A screw stop 65 may be mounted on the end of the slide portion 62 to prevent movement of the slide portion through the tubular guide 64.

Figure 4:
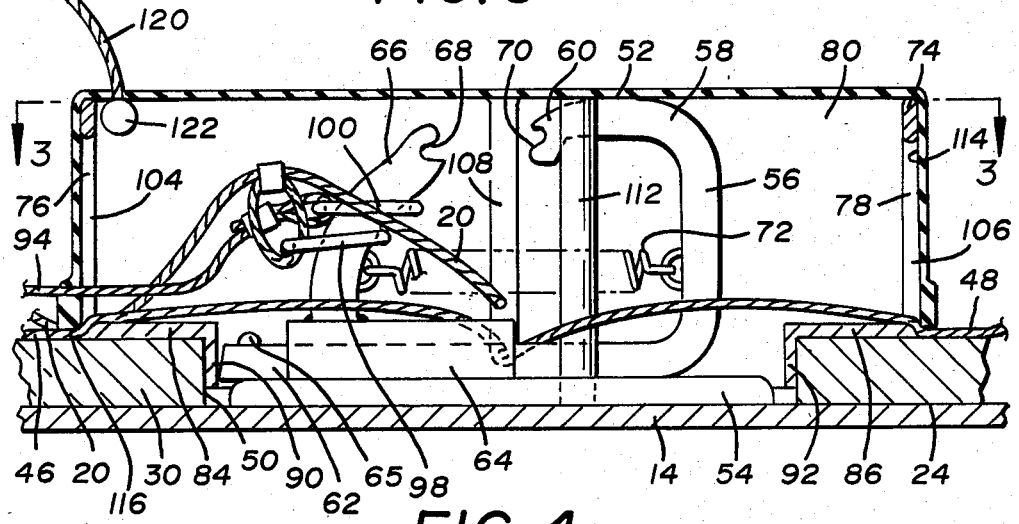
FIG. 4 is a fragmentary sectional view taken along the line 4—4 in FIG. 3.
Figure 5:
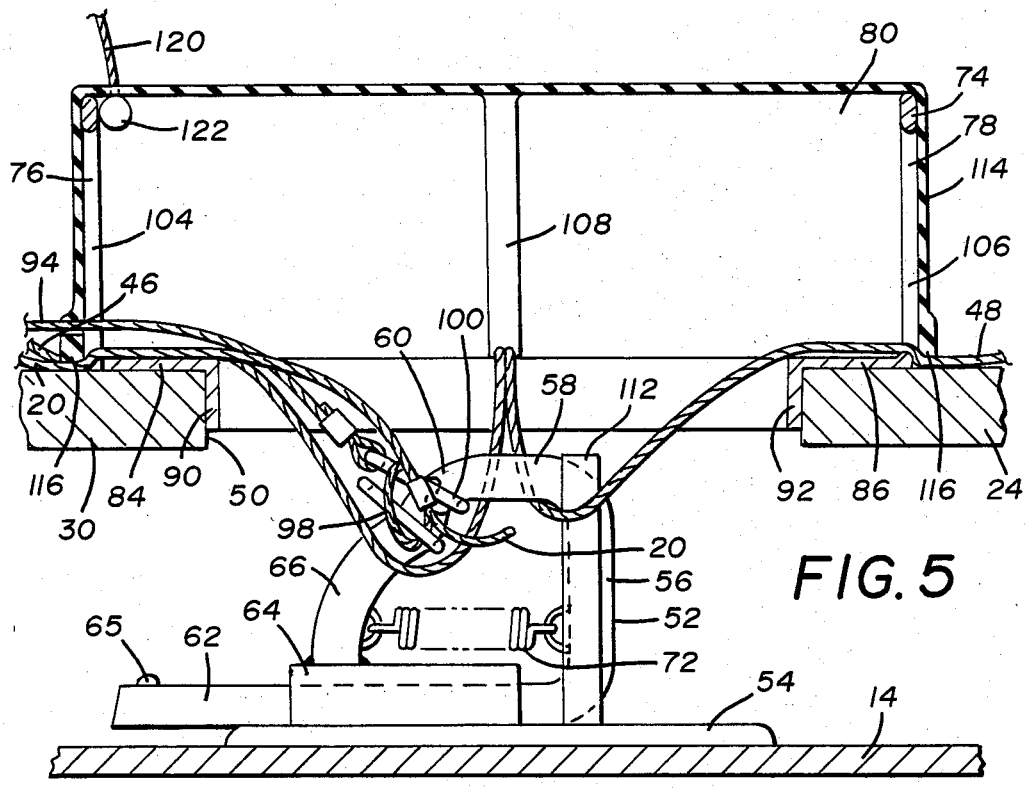
FIG. 5 is a view like FIG. 4 but showing the container lifted off the deck and the locking hook actuated for operation of the raft in the float free mode.

A locking hook post 66 is mounted on the base 54 and extends upwardly from the deck 14 for engagement with the distal end 60 of the locking hook 56 in the closed position shown in FIG. 5. The end of the locking hook post 66 and the distal end 60 of the locking hook 56 may have interlocking fingers 68 and 70, as shown in FIG. 4, to provide a more rigid retaining member 52 in the closed position. Spring means such as a coil spring 72 is connected to the locking hook 56 and to the locking hook post 66 to urge the locking hook towards the locking hook post.

As shown in the drawings a release hook guide such as rectangular box member 74 is mounted on the bottom member 30 of the container 24 around the opening 50. The box member 74 has a partially open bottom and end walls 76 and 78 connected by side walls 80 and 82. End pieces 84 and 86 connect the bottoms of the side walls 80 and 82 at the end walls 76 and 78, respectively, for fastening to the bottom member 30 of the container 24 as by bolts 88. The end pieces 84 and 86 may have flanges 90 and 92 extending between the walls 80 and 82 in overlapping relationship with the edges of the opening 50 in the bottom member 30 of the container 24.

Figure 3:
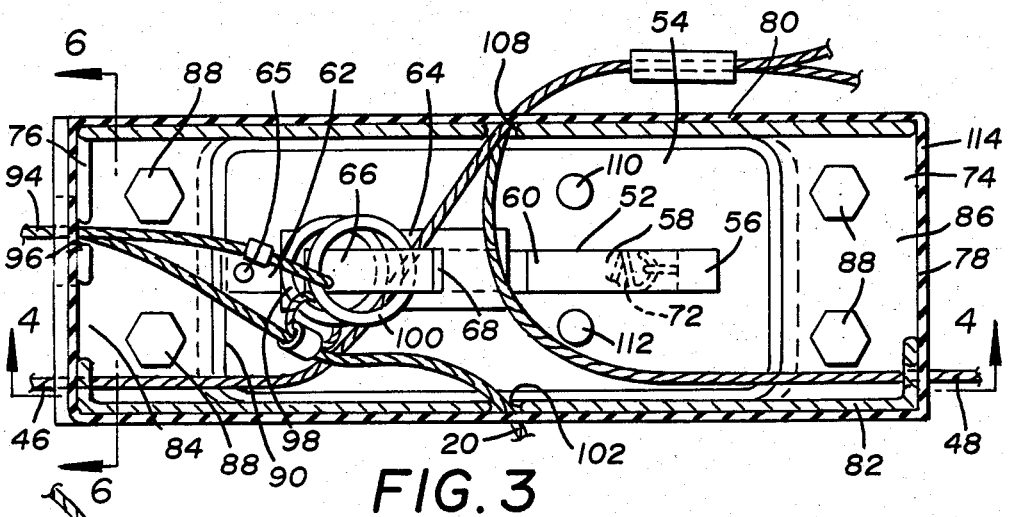
FIG. 3 is an enlarged fragmentary sectional plan view taken along the line 3—3 in FIG. 4 showing the retaining member and the release hook guide embodying the invention in the installed condition.

As shown in FIGS. 3 and 4, the slide portion 62 of the locking hook 56 engages the flange 90 of the box member 74 with the container 24 latched to the deck 14. This holds the locking hook 56 in the open position for installation purposes.

A painter line 94 connected to the raft extends through slot 96 in end wall 76 to a painter line connecting means such as painter line ring 100 which is placed over the locking hook post 66. As shown in FIG. 4, the locking hook post 66 is sloped towards the upper end 58 of the locking hook 56 so that when the painter line 94 is pulled away from the upper end the painter line ring 98 will be urged towards the base 54. The painter line 94 is preferably around 100 feet (30.48 meters) long and contains a 500 pound (226.8 kilograms) weak link which will break if the deck submerges beyond 100 feet (30.48 meters).

The release lanyard 20 connected to the davit hook 18 also has lanyard connecting means such as lanyard ring 98 positioned over the locking hook post 66 and under the painter line ring 98 with one end extending through the slot 96 in the end wall 76 and the other end extending through a slot 102 in side wall 82. The raft actuating cable 46 extends through an opening 104 in the end wall 76 and the raft actuating cable 48 extends through an opening 106 in the end wall 78 to the pins 44 holding the lid 32 on the container 24. Both of these cables 46 and 48 pass through the space between the locking hook 56 and the locking hook post 66 and then through a slot 108 in the side wall 80 where they are connected. The cables 46 and 48 are also connected to the davit ring 22. Guide pins 110 and 112 may be mounted on the base 54 at positions adjacent the locking hook 56 for guiding the raft actuating cable 48 through the locking hook and preventing the cable from opening the hook during operation in the float free mode. The guide pins 110 and 112 also protect the locking hook 56 from the box member 74 when it is lifted off the deck 14 in the float free mode.

A cover 114 of resilient material such as rubber having sides slidably engageable with the end walls 76 and 78 and side walls 80 and 82 of the box member 74 is mounted over the box member with bottom edges 116 engageable with the bottom member 30 of the container 24 for gripping the raft actuating cables 46 and 48 and the release lanyard 20 in the stored condition of the raft. An aperture 118 that is preferably smaller than the painter line ring 98 is provided in the end wall of the cover 114 which is engageable with the end wall 76 of the box member 74 so that the painter line 94 may be gripped by the cover and the painter line ring may be forced through the aperture. As shown in FIGS. 3 and 4 the cover 114 seals the retaining member 52 in the box member 74 and also maintains the painter line 94, release lanyard 20, and raft actuating cables 46 and 48 in position.

Figure 6:
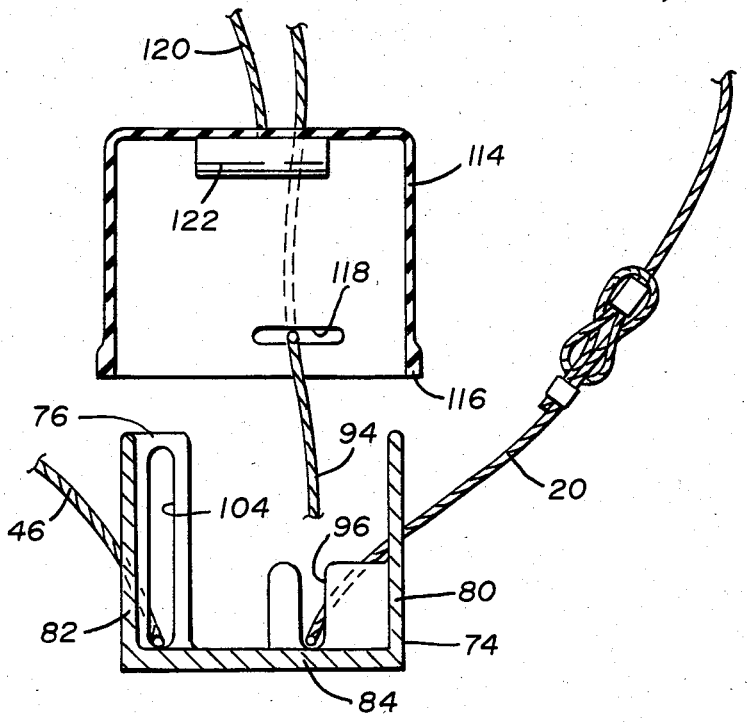
FIG. 6 is a sectional view taken along the line 6—6 in FIG. 3 but showing the cover lifted for operation of the apparatus in the davit launch mode.

In the davit launch mode the raft is launched by turning a winch (not shown) on the davit 12 to wind up the fall 16 causing the raft supporting davit ring 22 to be pulled out of the container 24. A cover removing line 120 is connected to the davit ring 22 and extends through the top of the cover 114 where it is connected to a block 122 so that upon movement of the davit ring 22 out of the container 24 the cover 114 will also be pulled off the box member 74 as shown in FIG. 6. This releases the raft actuating cables 46 and 48 and the release lanyard 20 as shown in FIG. 6. The release lanyard 20 pulls the lanyard ring 98 off the locking hook post 66 and also helps pull the painter line ring 100 off the locking hook post. The raft actuating cables 46 and 48 are then pulled through the openings 104 and 106 in the end walls 76 and 78 to remove the pins 44 from the posts 42 and release the lid 32. The raft is inflated and the lanyard 20 is in position for releasing the davit hook when the raft is lowered to the water as in a normal davit launch mode. The fall 16 may then be raised and attached to a davit ring 22' of the container 24' for launching the second raft.

In the float free mode of launching the submerged life raft from the container 24 at a depth of from 10 to 25 feet (3.05 to 7.62 meters), the hydrostatic release mechanism 38 is actuated and the container 24 is released from the lug 40. The container 24 floats upwardly away from the deck 14, actuating the retaining member 52 by releasing the slide portion 62 of the locking hook 56. The spring 72 then urges the locking hook 56 into engagement with the locking post 66 as shown in FIG. 5. As the container 24 is lifted off the deck 14, the raft actuating cables 46 and 48 are placed in tension and pull the pins 44 out of the posts 42 releasing the lid 32 of the container 24. Lifting of the container 24 off the deck 14 automatically actuates the raft inflating means and releases the girt from the deck. The release lanyard 20 is placed in tension and opens the davit hook 18 for releasing the davit ring 22. The painter line 94 is connected to the locking hook 56 and thereby limits the movement of the raft on the surface of the water to the area above the retaining member 52.

The float free operation of the raft in the other container 24', shown in FIG. 1, where the fall 16 is not connected to davit ring 22' is the same as the float free operation described hereinabove except that release lanyard 20' is not connected to the davit hook 18 and does not function. Lifting of the cover 114' pulls the painter line ring 98' off the locking hook post 66'.

The invention is capable of other modifications and adaptions by those having ordinary skill in the art and is more particularly defined by the appended claims.

I claim:

1. A means for releasing a raft from a submerged deck wherein at least one latch connects the raft to the deck and wherein a painter line is fastened to the raft comprising: a retaining member mounted to the deck, the painter line being removably connectable to the retaining member; a means for releasing the latch upon the deck reaching a predetermined depth below a water surface and the retaining member being actuated in response to a lifting of the raft from the deck to secure the painter line to the deck and thereby limit movement of the raft, in the inflated condition, on the water surface to an area generally above the retaining member; the raft being positioned in a container, the container having an enclosure for said raft in a deflated condition, the latch releasably connecting the container and the deck, and the retaining member being in operable engagement with the container for actuation in response to a lifting of the container upon release of the latch; the retaining member further including a locking hook assembly having a base configured for mounting on the deck, a locking hook post mounted to said base and extending upwardly from the deck, a locking hook having an upper end portion for engagement with the locking hook post in the closed position and a lower slide portion, a locking hook guide member on said base having a guide configured for receiving and guiding the lower slide portion of the locking hook and a spring means for urging the locking hook into the closed position, the slide portion being engageable with the container in the open position of said locking hook for holding the upper end portion of the locking hook in spaced relation to the locking hook post.

2. The raft release apparatus in accordance with claim 1 wherein said raft is normally launched from the deck by a davit and fall connected to said raft and said retaining member has painter line connecting means permitting removal of said painter line from said retaining member during launching in the davit launch mode from said deck and securing of said painter line to said deck after release of said raft from said deck in the float free mode.

3. The raft release apparatus in accordance with claim 1, wherein said container has a lid for enclosing said raft in said space, releasable fasteners connecting said lid to said container, raft actuating cables connecting said fasteners to said retaining member and said releasable fasteners being disconnected to permit opening of said lid in response to actuation of said retaining member and further lifting of said container from said deck to pull said raft actuating cables away from said fasteners.

4. The raft release apparatus in accordance with claim 3 wherein said raft is normally launched from the deck in a davit launch mode by a davit and fall connected to a raft lifting davit ring by a davit hook, a release lanyard connected to said davit hook for releasing said davit ring and said retaining member having lanyard connecting means permitting removal of said lanyard from said retaining member during launching in the davit launch mode and retaining said lanyard in the float free mode during lifting of said raft from said deck to place said lanyard in tension and release said lifting davit ring from said davit hook.

5. A raft release apparatus in accordance, with claim 4 wherein said container has a bottom member, an opening in said bottom member for said retaining member, a release hook guide mounted on said container around said opening, said release hook guide having walls extending upwardly from said bottom member and said walls having an aperture for said painter line, slots for said release lanyard and openings for said raft actuating cables.

6. A raft release apparatus in accordance with claim 5 wherein said release hook guide mounted on said bottom member of said container has a cover and said cover has sides slidably engageable with said walls, said sides having bottom edges engageable with said bottom member of said container for gripping said raft actuating cables and said release lanyard between said bottom edges and said bottom member in the stored condition of said raft.

7. A raft release apparatus in accordance with claim 6 wherein said cover is of a resilient rubber-like material for elastically gripping said walls of said release hook guide.

8. A raft release apparatus in accordance with claim 7 wherein said cover is connected to a davit hook wherein during normal launching of said raft in the davit launch mode said cover is pulled off said release hook guide to release said lanyard and said raft actuating cables from between said bottom edges of said cover and said bottom of said container and thereby permit removal of said lanyard and said cables from said retaining member.

9. A raft release apparatus in accordance with claim 8 wherein said cover is connected to said davit hook by a cover removing line for removing said cover during launching of said raft in the davit launch mode.

10. The raft release apparatus in accordance with claim 1 wherein said locking hook post is sloped toward said upper end of said locking hook to urge said painter line connecting means toward said base when pulled away from said upper end.

11. The raft release apparatus in accordance with claim 1 wherein said upper end portion of said locking hook has a tight radius at a distal end so that said distal end is closer to said base than said upper end portion and will retain said painter line when in the closed position.

12. A raft release apparatus in accordance with claim 1 wherein at least two guide pins are mounted on said base at positions adjacent said locking hook for protecting said locking hook.

13. A method for releasing a raft from a deck submerged beneath a water surface to a predetermined depth wherein a latch means holds the raft to the deck and wherein the raft is usually launched by a davit launch including a davit and fall connectable to said raft by a davit hook having a release lanyard comprising:

(a) releasably fastening a painter line connectable to the raft to a retaining member mounted on the deck at least prior to submersion, (b) releasably fastening the release lanyard to the retaining member at least prior to submersion, (c) actuating said latch means to release the raft from the deck in response to a submerging of the deck to the predetermined depth, (d) actuating the retaining member to secure the painter line to the retaining member in response to a lifting movement of the raft off the deck to limit movement of the raft on the water surface to an area generally above the retaining member, (e) securing the release lanyard to the retaining member upon actuation of the retaining member at the predetermined depth, and (f) releasing the raft from the davit hook in response to lifting of the raft off the deck and tensioning of the release lanyard to open the davit hook.

14. The method of claim 13 wherein said raft is enclosed in a container connected to said deck by said latch means and has a lid connected to a bottom member of said container by releasable fasteners actuated by raft actuating cables extending through said retaining member further comprising (g) releasing said fasteners connecting said lid member and the bottom of said container in response to actuation of said retaining member and lifting of said container off said deck to pull on said cables.

15. The method of claim 14 wherein said release lanyard and said raft actuating cables are held in position by positioning said release lanyard and said cables in slots and openings in walls of a release hook guide mounted on said bottom member of said container and positioned around said retaining member and placing a resilient cover over said walls to engage said release lanyard and said raft actuating cables in the stored condition of said raft.

* * * * *